US005427369A

United States Patent [19]

Baquet, Jr.

[11] Patent Number: 5,427,369

[45] Date of Patent: Jun. 27, 1995

[54] TENNIS INSTRUCTIONAL DEVICE

[76] Inventor: Fermin O. Baquet, Jr., 19600 NW. 48 Ct., Miami, Fla. 33055

[21] Appl. No.: 236,604

[22] Filed: May 2, 1994

[51] Int. Cl.[6] ..... A63B 69/38

[52] U.S. Cl. ..... 273/29 A; 273/413

[58] Field of Search ..... 273/29 R, 29 A, 26 R, 273/26 E, 413, 184 B, 185 D

[56] References Cited

U.S. PATENT DOCUMENTS

| | | | |
|---|---|---|---|
| 3,948,517 | 4/1976 | Feiler | 273/29 A |
| 4,105,203 | 8/1978 | Cho | 273/29 A |
| 4,417,730 | 11/1983 | Weiner | 273/29 A |
| 4,460,172 | 7/1984 | Hogan | 273/29 A |
| 4,865,319 | 9/1989 | Drazinakis | 273/29 A |

FOREIGN PATENT DOCUMENTS

| | | | |
|---|---|---|---|
| 2548914 | 1/1985 | France | 273/29 A |

*Primary Examiner*—Raleigh W. Chiu
*Attorney, Agent, or Firm*—J. Sanchelima

[57] ABSTRACT

A tennis instructional device having telescoping tubes which permit a user to raise or lower the position of tennis balls in order to practice his or her tennis strokes and serves. The tennis balls are cooperatively held perpendicular to the telescoping tubes by a sleeve and an arm. The sleeve journals the telescoping tubes and can be positioned higher, or lower, on the telescoping tubes by an assembly of holes which pass through both the sleeves and the telescoping tubes. A user may pass a pin through the hole to temporarily fix the position of the sleeves, on the telescoping tubes, and the relative positions of the telescoping tubes to one another. The arms are received by the sleeves and the tennis balls are held at a distance from the arms by a resilient material that will return the tennis ball to its original position after being struck by a user's racquet.

2 Claims, 5 Drawing Sheets

TENNIS INSTRUCTIONAL DEVICE

BACKGROUND OF THE INVENTION

1. Field of the Invention

The present invention relates to athletic instructional devices, and more particularly, to device for teaching, and perfecting, tennis strokes.

2. Description of the Related Art

Applicant believes that there have been a number of earlier tennis instructional devices. However, they differ from the present invention because none of the prior inventions permit a user to improve his or her tennis skills in a manner equivalent to the present invention.

SUMMARY OF THE INVENTION

It is one of the primary objects of the present invention to provide a device which allows a user to improve his or her tennis game by practicing his or her tennis strokes.

It is another object of the present invention to provide a device which permits either a right or left handed user to practice his or her forehand stroke.

It is still another object of this invention to provide a device which permits either a right or left handed user to practice his or her backhand stroke.

It is still another object of this invention to provide a device which permits either a right or left handed user to practice his or her tennis service and overhand strokes.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
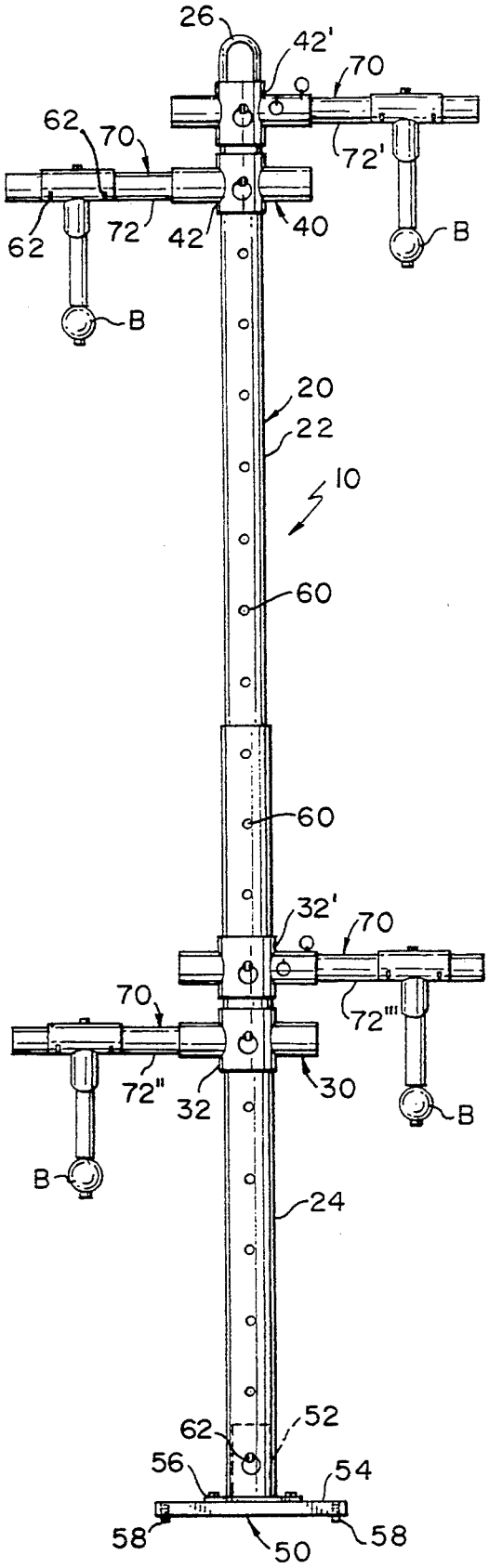
FIG. 1 represents an orthographic view of the present invention.

Referring now to the drawings, where the present invention is generally referred to with numeral 10, it can be observed that it basically includes telescoping assembly 20, lower sleeve assembly 30, upper sleeve assembly 40, base assembly 50, ball holder assembly 70 and guard assembly 80.

Figure 9:
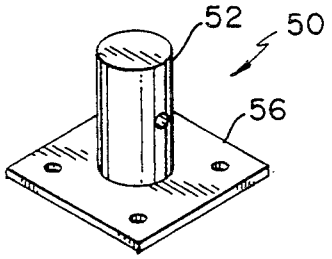
FIG. 9 shows an isometric view of the base of the present invention.
Figure 8:
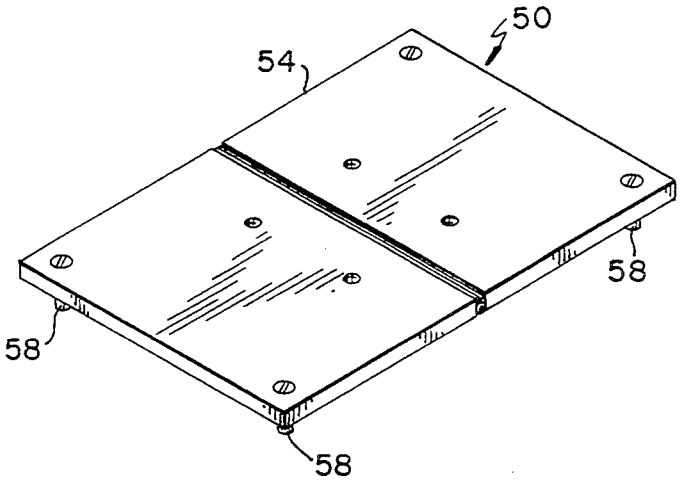
FIG. 8 represents an isometric view of the base of the present invention.
Figure 11:
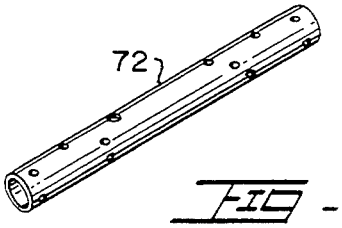
FIG. 11 is an elevational representation of a tube of the ball holder assembly.
Figure 12:
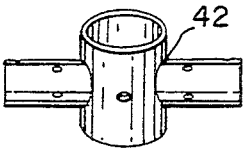
FIG. 12 is an elevational view of a sleeve.
Figure 13:
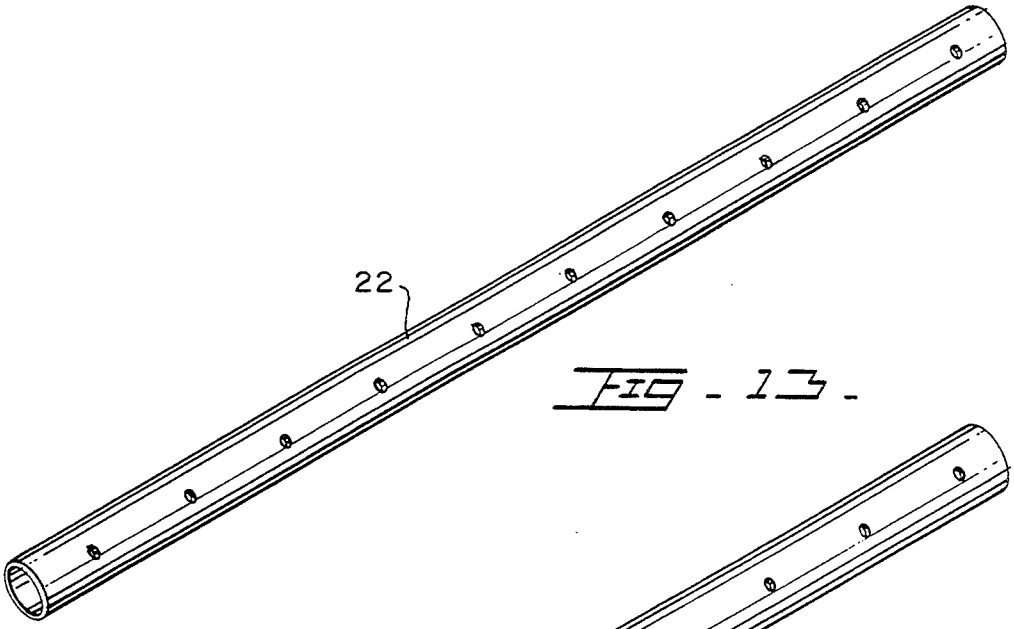
FIG. 13 shows is an elevational view of the inner tube, of the telescopic assembly, of the present invention.
Figure 14:
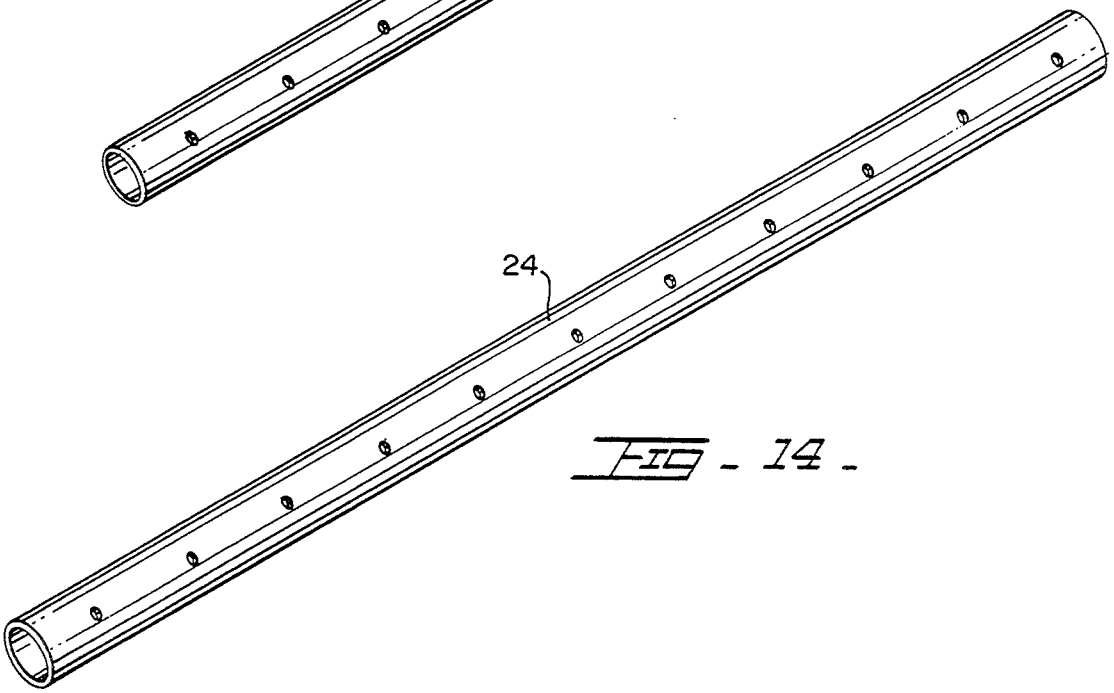
FIG. 14 depicts an elevational view of the outer tube of the telescopic assembly.

Referring now to FIGS. 1, 2, 8 and 9 where it can be seen that base assembly 50 includes support 52, base 54, plate 56 and levels 58. Referring particularly to FIGS. 8 and 9, support 52 is rigidly mounted to plate 56 which is removably mounted to base 54. Levels 58 permit a user to adjust the position of base 54 until it is horizontal. Referring again to FIGS. 1 and 2, it can be seen that support 52 snugly and removably receives outer tube 24. Holes 60, of support 52 and outer tube 24, may be aligned so that pin 62 may pass therethrough, thereby removably fastening outer tube 24, of telescoping assembly 20, to base assembly 50. It can also be seen in FIGS. 1, 2, 13 and 14 that telescoping assembly 20 includes inner tube 22, outer tube 24 and loop 26. Inner tube 22 is journaled by outer tube 24 and may be extended in and out of inner tube 22 to permit a taller, or shorter, user to reach the balls B of upper ball holder assemblies 70. The relative position of inner tube 22, to outer tube 24, can be adjusted by extending or retracting inner tube 22 from outer tube 24 and aligning holes 60 so that pins 62 hold inner tube 22 and outer tube 24 in a fixed relative position until re-positioned by the user.

Referring now to FIGS. 1, 2, 4, 5, 6 and 12, upper sleeve assembly 40 includes sleeves 42 and 42'. Sleeves 42 and 42' can be adjusted along the length of inner tube 22 by fastening sleeves 42 and 42' to inner tube 22 and aligning the holes 60, of sleeves 42 and 42', with the holes 60 of inner tube 22 and passing pin 62 therethrough to hold sleeves 42 and 42' in position. Similarly, lower sleeve assembly 30 includes sleeves 32 and 32'. The position of sleeves 32 and 32' may be adjusted along the length of outer tube 24 by positioning sleeves 32 and 32' so that they journal outer tube 24 and aligning holes 60, of sleeves 32, 32', with the holes 60 of outer tube 24 and passing pin 62 therethrough to hold sleeves 32 and 32' in position.

Figure 10:
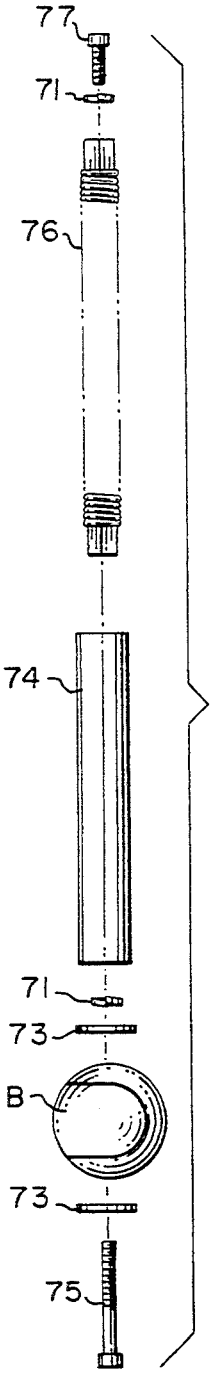
FIG. 10 illustrates an exploded elevational view of a portion of the ball holder assembly.

Referring now to FIGS. 1 and 10, it can be seen that ball holder assemblies 70 include pressure washers 71, tubes 72, 72', 72'', 72''', flat washer 73, padding 74, distal screw 75, spring 76 and proximal screw 77. It is apparent from FIGS. 1, 4, 11 and 12 that sleeves 42 and 42' of upper sleeve assembly 40 slidably receive tubes 72 and 72' respectively. Sleeve 42 is cooperatively held in position, to with respect to inner tube 22, by holes 60 and pins 62. Sleeve 42' is also held in position in the same manner. Tubes 72, 72', 72'' and 72''' are removably fastened to sleeves 42, 42', 32 and 32' respectively. Tubes 72, 72', 72'' and 72''' are cooperatively held in position by holes 60 and pins 62.

Ball B, which a user will strike with a racket in order to practice his or her tennis strokes, is held in position by a spring or resilient member 76. When the ball B is hit by the user, spring 76 returns ball B to its original position, as seen in FIG. 1. Padding 74 journals spring 76 and prevents a user from damaging the face of his or her racket.

Figure 6:
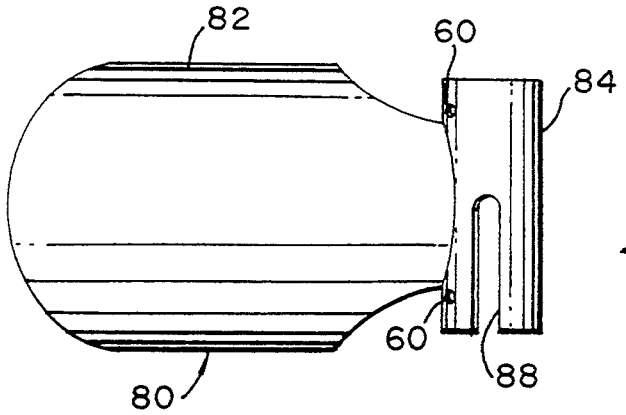
FIG. 6 illustrates a top elevational view of the guard assembly.

Referring now to FIGS. 1, 2, 5 and 6, it is apparent that guard assembly 80 includes blade 82, shoulder 84, stop 86 and groove 88. Guard assembly 80 is positioned on tubes 72, 72', 72'', 72''' so that when ball B is hit by a user that the motion of ball B is arrested when ball B contacts blade 82. Shoulder 84 journals tube 72 and is positioned on tube 72 such that blade 82 is perpendicular to ball B. Stop 86, in cooperation with blade 82, confines the motion of ball B to a 90 degree range between the extremes of the position of the blade 82 and stop 86. As best seen in FIG. 6, groove 88 prevents guard assembly 80 from rotating around tube 72 when ball B is struck by a user. Guard assembly 80 performs the same function when it is fastened to tubes 72', 72'' and 72'''.

Figure 2:
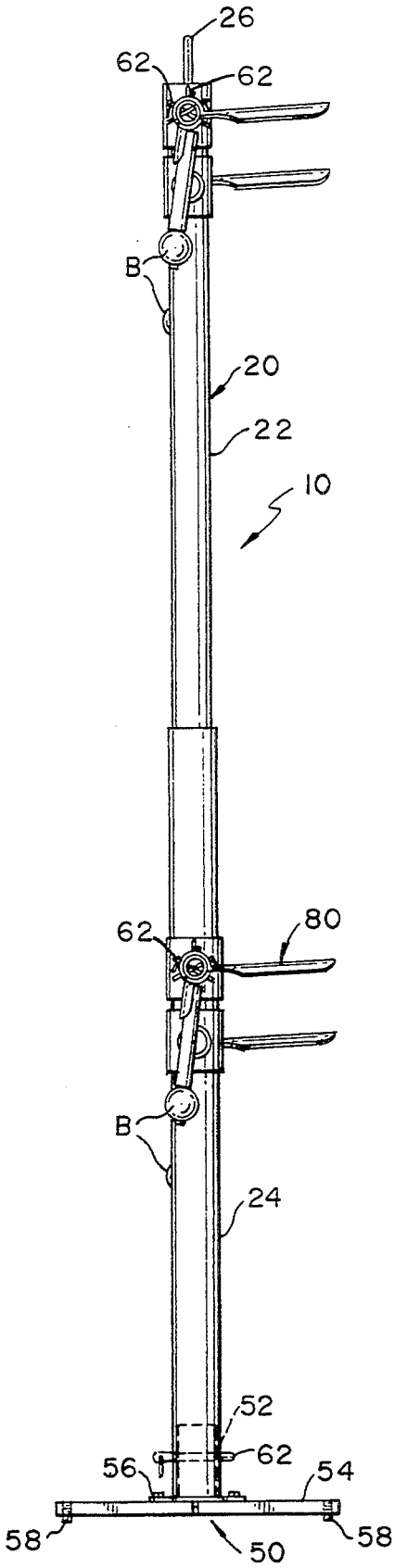
FIG. 2 shows a side orthographic view of the present invention.
Figure 3:
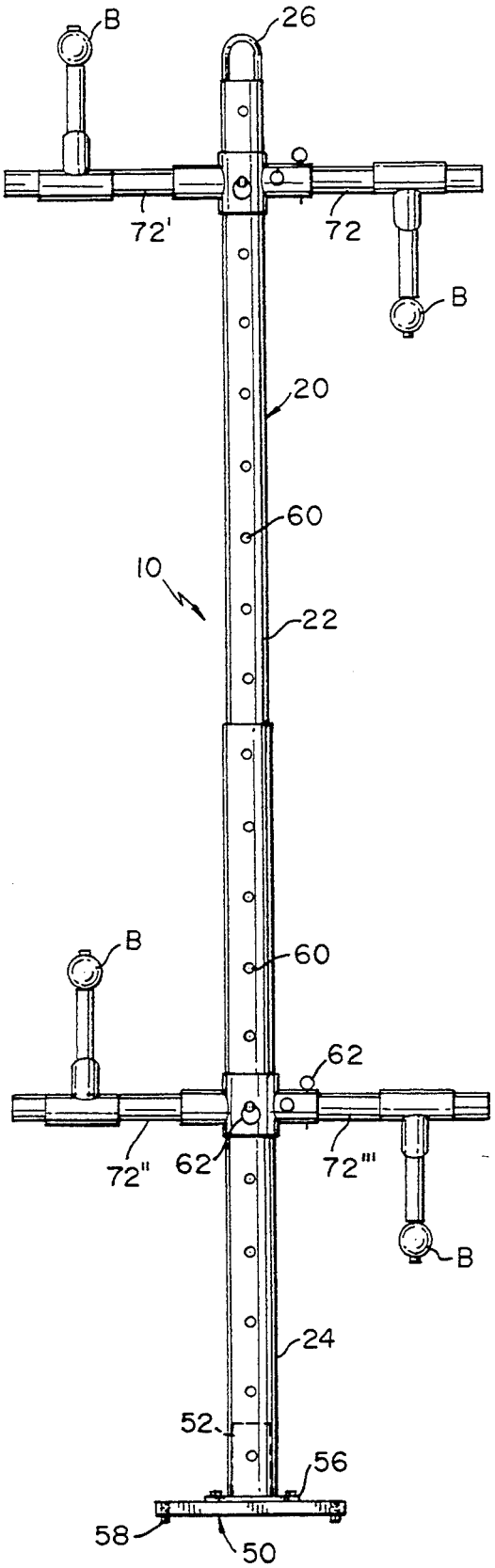
FIG. 3 illustrates an orthographic view of the present invention in one of the positions which permit a user to practice tennis strokes.
Figure 7:
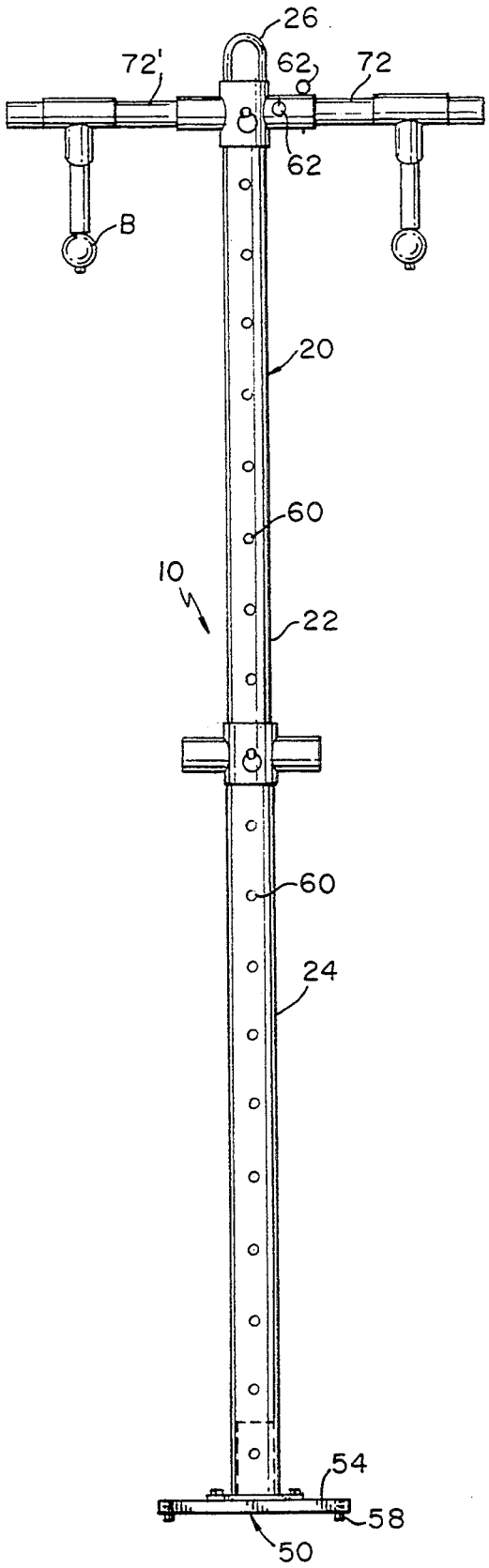
FIG. 7 depicts an orthographic view of the present invention in one of the positions which permit a user to practice tennis strokes.
Figure 4:
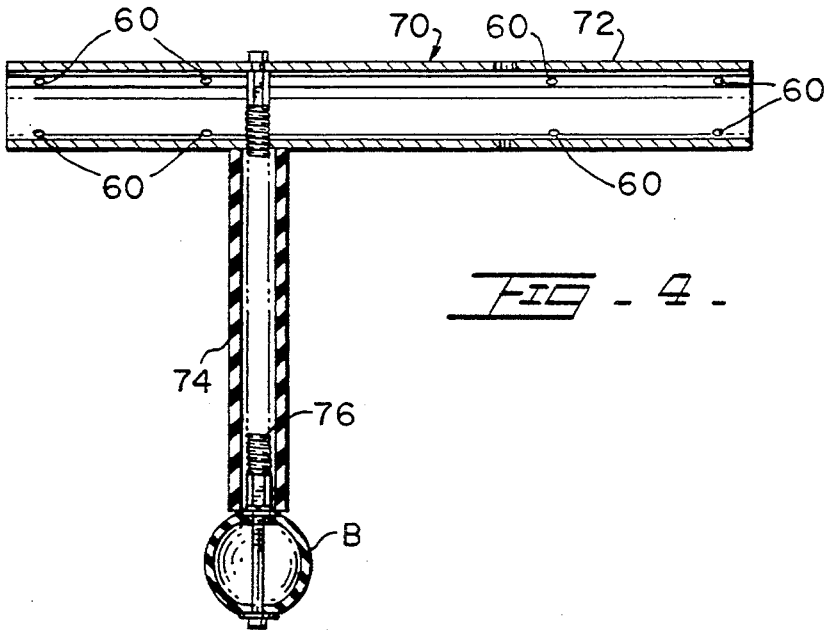
FIG. 4 is a representation of is a cross-sectional view of the arm assembly of the present invention.
Figure 5:
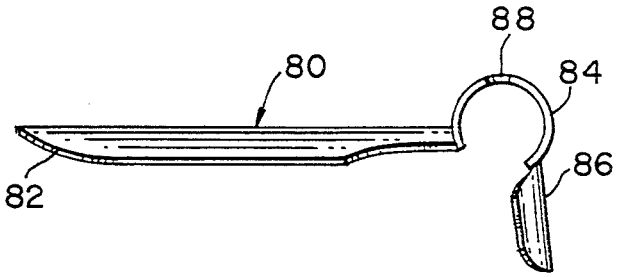
FIG. 5 shows a side elevational view of the guard assembly.

Referring now to FIG. 3, it can be seen that a user can position ball holder assemblies 70, and hence balls B, so that a user can practice forehand, backhand and overhand shots. For example, a user may practice his or her backhand shot by striking ball B which is attached to tube 72''. Also, a user may practice his or her forehand by striking ball B which is attached to tube 72'''. In addition, as best seen in FIG. 7, a user may practice his or her overhand shots by striking either of balls B attached to tubes 72 or 72'. A user desiring to practice his or her service may do so by extending inner tube 22 to a position such that balls B, which are connected with tubes 72 or 72', are located at the height at which the user strikes a tennis ball when he or she is serving Also, referring now to FIGS. 1, 2, 4, 5 and 6, it can be seen that tubes 72, 72', 72'' and 72''' can be rotated inside sleeves 42, 42', 32 and 32' respectively, in order to change the position of balls B. For example, as seen in FIGS. 1 and 2, Balls B may be positioned downwardly so that they are below arms 72, 72', 72'' and 72'''. An alternative position of Balls B is found in FIG. 3, where Balls B which are connected to arms 72' and 72''' and positioned. These illustrations are for the example purposes only and Balls B can be rotated a full 360 degrees around the axes of arms 72, 72', 72'' and 72''' and the position of Balls B can be held in position by passing a pin 62 through holes 60 of sleeves 42, 42', 32 and 32' and arms 72, 72', 72'' and 72''' respectively.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A tennis instructional device that allows a user to practice tennis strokes and serves, comprising:

A. upright elongated tubular assembly having upper and lower members that are telescopically mounted within each other;

B. at least one elongated member perpendicularly mounted to said upright elongated tubular assembly;

C. at least one resilient means for absorbing the impact of said strokes, said resilient means having first and second ends, said first end being mounted to said elongated member and said second end extending radially outwardly thereof;

D. a padding covering said resilient means;

E. a ball mounted to said second end; and

F. guard means having a blade and a stop for restricting the motion of said ball.

2. The tennis instructional device as set forth in claim 1, wherein said upright elongated tubular means includes a base that is removably mounted to said lower member.

* * * * *